United States Patent [19]

Coons, Jr.

[11] Patent Number: 4,537,650

[45] Date of Patent: Aug. 27, 1985

[54] SHEET BINDING APPARATUS

[75] Inventor: Robert A. Coons, Jr., Holcomb, N.Y.

[73] Assignee: Xerox Corporation, Stamford, Conn.

[21] Appl. No.: 606,040

[22] Filed: May 1, 1984

[51] Int. Cl.[3] ..... B05C 1/02; B05C 11/105; B42C 9/00

[52] U.S. Cl. ..... 156/384; 118/205; 118/236; 118/268; 156/563; 156/578; 222/187; 412/37

[58] Field of Search ..... 156/578, 291, 558, 559, 156/563, 384; 118/205, 236, 264, 266, 268; 222/187; 412/8, 37

[56] References Cited

U.S. PATENT DOCUMENTS

| | | | |
|---|---|---|---|
| 2,806,443 | 9/1957 | Horn et al. | 118/236 |
| 2,823,633 | 2/1958 | Meier et al. | 118/264 |
| 3,709,191 | 1/1973 | Will | 118/264 |
| 3,735,730 | 5/1973 | Mitter | 118/205 |
| 4,386,576 | 6/1983 | Johnson | 118/266 |

*Primary Examiner*—Michael Wityshyn

*Attorney, Agent, or Firm*—H. Fleischer; J. E. Beck; R. Zibelli

[57] ABSTRACT

An apparatus in which a plurality of sheets are adhesively bound together to form a booklet thereof. A glue applicator blade is reciprocated into and out of contact with a marginal region of sheets advanced thereto in seriatim. The glue applicator blade forms a line of adhesive on the marginal region of each sheet. The sheets are overlayed and pressed together to form a bound booklet thereof.

14 Claims, 5 Drawing Figures

SHEET BINDING APPARATUS

This invention relates generally to a printing system, and more particularly concerns an apparatus for binding together a plurality of sheets to form a booklet thereof.

A typical printing system utilizes the process of electrophotographic printing wherein a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In commercial printing systems of the foregoing type, the copy sheet, with the information permanently affixed thereto, is transported to a compiler. After the requisite number of sheets, corresponding to a set of original documents is compiled, the copies of the set are permanently affixed to one another to form a booklet thereof. Hereinbefore, a stapling apparatus was employed to secure the sheet to one another to form the booklet thereof. Alternatively, the sheets are bound adhesively to one another. Frequently, commercial printing machines utilize a recirculating document handling system to advance successive original documents from a stack thereof to the exposure station for reproduction. When a recirculating document handling system is employed, the printing system produces a large number of copies rapidly. This type of system may be employed to form sets or booklets of copies. In order for each set to have a bound, finished look, it is desirable to adhesively secure the sheets of the set to one another. Numerous methods are known in the art for adhesively securing sheets to one another. It is particularly desirable to be capable of adhesively binding small sets or booklets numbering from 2 to 50 pages in a relatively simple and inexpensive fashion.

Various approaches have been devised to adhesively bind sheets to one another. The following disclosures appear to be relevant:

U.S. Pat. No. 1,485,905
Patentee: Bischof
Issued: Mar. 4, 1924
U.S. Pat. No. 1,785,261
Patentee: Howard
Issued: Dec. 16, 1930
U.S. Pat. No. 2,806,443
Patentee: Horn et al.
Issued: Sept. 17, 1957
U.S. Pat. No. 2,925,611
Patentee: Patterson Issued: Feb. 23, 1960
U.S. Pat. No. 2,982,979
Patentee: Patterson
Issued: May 9, 1961
U.S. Pat. No. 3,336,024
Patentee: Brechner
Issued: Aug. 15, 1967
U.S. Pat. No. 3,404,880
Patentee: Porter, Jr. et al.
Issued: Oct. 8, 1968
U.S. Pat. No. 3,793,016
Patentee: Eichorn
Issued: Feb. 19, 1974
U.S. Pat. No. 3,794,550
Patentee: Taillie
Issued: Feb. 26, 1974
U.S. Pat. No. 4,343,673
Patentee: Smith, Jr. et al.
Issued: Aug. 10, 1982
U.S. Pat. No. 4,387,002
Patentee: Knecht
Issued: June 7, 1983
U.S. Pat. No. 4,406,247
Patentee: Baughman, et al.
Issued: Sept. 27, 1983
PCT Publication WO83/04215
Inventor: Baughman et al.
Published: Dec. 8, 1983

The pertinent portions of the foregoing disclosures may be briefly summarized as follows:

Bishof discloses a book binding machine which uses adhesive or staples.

Howard describes an adhesive binder which employs presser bars to hold a sheet in position to receive glue. Jogger plates align the sheets. A glue knife comprising a vertically moving blade receives glue from a supply belt and applies a line of glue to the sheets. In operation, the glue knife is brought into contact with the sheets to apply glue to the upper surfaces of the folded tongues at the ends thereof. Each successive pair of sheets is pressed onto the sheet below it by the glue knife and presser bars so that the tongues on alternate sheets will be joined together by the glue.

The Patterson patents describe a pasting machine including a plurality of spaced arms with each arm having a downward turned finger that dips into adhesive and then contacts the sheets to form a dot of glue thereon.

Brechner discloses a glue applicator having a storage housing with a bottom plate secured thereto. The bottom plate has holes with tubular nozzles protruding outwardly therefrom. The nozzles are equally spaced from one another. The bottom plate also acts as a presser plate, spacing the nozzles from the sheets and pressing the glued sheets together.

Porter discloses a glue applicator associated with a sheet collator having two spaced nozzles for forming two dots of glue on a sheet.

Eichorn and Taillie describe an electrophotographic printing machine using an adhesive binder and staples. The adhesive is toner particles.

Smith, Jr. et al. describes an electrophotographic printing machine having a finishing station which may also include a stitching station.

Knecht discloses nozzles for discharging paste and a cap for enclosing the nozzles to prevent drying of the paste.

Baughman et al. (U.S. Pat. No. 4,406,247) discloses an adhesive applicator having a nozzle through which adhesive can be dispensed onto sheets being driven in seriatim therepast. Adhesive is provided in a pressurized cartridge and delivered from the cartridge to the nozzle under pressure. A valve controls the flow of the adhesive from the nozzle.

Baughman et al. (WO83/04215) describes a sheet binding apparatus for use with a high speed document copier. The sheet binding apparatus is adapted to receive sheets moving along a first path and to apply adhesive adjacent to an edge of such sheets as they move in a direction perpendicular to the path. The binding apparatus includes a sheet drive mechanism for altering the direction of movement of the received sheets so as to advance the sheet along a second path which is substantially parallel with the edge to which the adhesive is to be applied. An adhesive applicator is stationarily positioned along the second path to apply a strip of adhesive to the sheets as they move therepast. After the adhesive is applied, the sheets are stacked, in registration, with the adhesive interposed between adjacent sheets.

In accordance with one aspect of the features of the present invention, there is provided an apparatus for adhesively binding together a plurality of sheets to form a bound booklet thereof. Means receive successive sheets. An operator replaceable cartridge comprises a housing storing a supply of adhesive therein. A glue applicator blade, of a length at least equal to the length of the marginal region of the sheet adapted to have glue deposited thereon, is in communication with the glue in the housing. Means are provided for extending a portion of the blade form the housing in the operative mode when applying glue to the sheets and retracting the portion of the blade extending from the housig in the inoperative mode. Means reciprocate the cartridge so that a portion of the blade extending outwardly from the housing contacts the marginal region of each successive sheet in the receiving means to apply a strip of glue thereon.

Pursuant to another aspect of the features of the present invention, there is provided a printing sytem. The printing system has means for reproducing indicia on successive sheets. Means are provided for advancing the sheets, in seriatim, along a sheet path. Means adhesively bind together the sheets along the marginal region thereof extending in a direction substantially perpendicular to the sheet path to form a bound booklet. The binding means comprises a housing storing a supply of adhesive therein. A glue applicator blade, of a length at least equal to the length of the marginal region of the sheet adapted to have the glue deposited thereon, is in communication with the glue in the housing. Means extend a portion of the blade from the housing in the operative mode when applying glue to the sheets and retract the portion of the blade extending from the housing in the inoperative mode. Means reciprocate the binding means so that the portion of the blade extending outwardly from the housing threeof contacts the marginal region of successive sheets to apply a strip of glue thereon.

Other aspects of the invention will become apparent as the following description proceeds and upon reference to the drawings, in which:

FIG. 3(*a*) is an enlarged, fragmentory, elevational view showing the glue applicator of the FIG. 3 binding apparatus in the operative mode.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
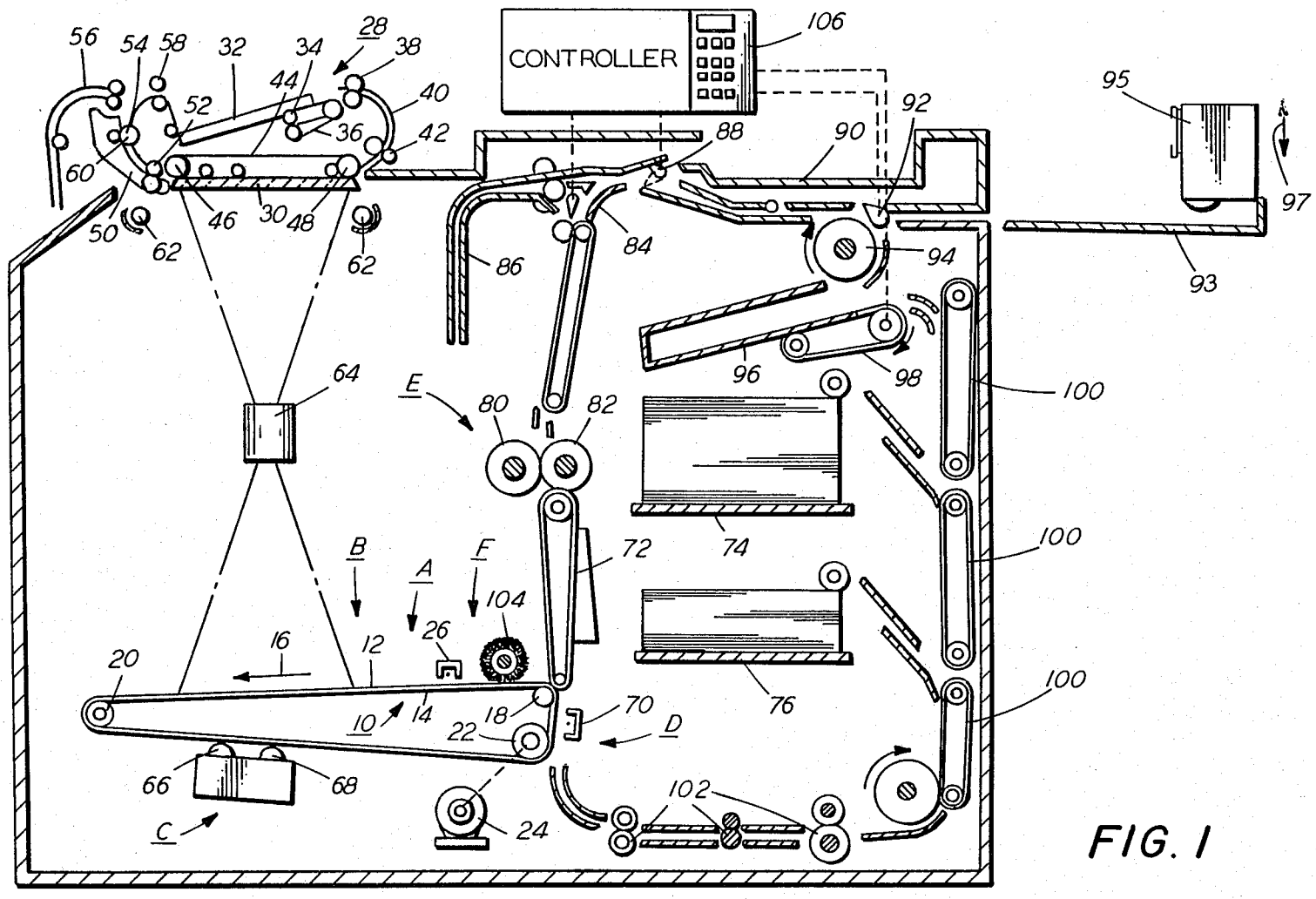
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of the illustrative electrophotographic printing machine incorporating the sheet binding apparatus of the present invention therein. It will become evident from the following discussion that the sheet binding apparatus is equally well suited for use in a wide variety of printing machines, and it is not necessarily limited in its application to the particular printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferrably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about a stripping roller 18, tensioning roller 20 and drive roller 22. Stripping roller 18 is mounted rotatably so as to be rotated with the movement of belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of the photoconductive surface passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28 is positioned over platen 30 of the printing machine. Document handling unit 28 sequentially feeds documents from a stack 32 of documents placed by the operator face down in a normal forward collated order in the document stacking and holding tray 34. A document feeder 36 is located below tray 34 forwards the bottom document in the stack to a pair of take-away rollers 38. The bottommost sheet is then fed by rollers 38 through document guide 40 to feed roll pair 42 and belt 44. Belt 44, entrained about a pair of opposed spaced rollers 46 and 48, respectively, advances the document onto platen 30. After imaging, the original document is fed from platen 30 by belt 44 into guide 50 and feed roll pairs 52 and 54. The document then advances into an inverter mechanism, indicated gnerally by the reference numeral 56, or back to the document stack through feed roll pair 58. Decision gate 60 is provided to divert the document either to the inverter or to feed roll pair 58. Imaging of a document is achieved by lamps 62 which illuminate the document on platen 30. Light rays reflected from the document are transmitted through lens 64. Lens 64 focuses the light image of the original document onto the charged portion of photoconductive surface 12 of the belt 10 to selectively dissipate the charge thereon. This records an electrostatic latent image on photoconductive surface 12 which corresponds to the informational areas contained within the original document. Thereafter, belt 10 advances the electrostatic latent image recorded on photoconductive surface 12 to development station C.

With continued reference to FIG. 1, at development station C, a pair of magnetic brush developer rollers, indicated generally by the reference numerals 66 and 68 advance developer material into contact with the electrostatic latent image. The latent image attracts toner particles from the carrier granules of the developer material to form a toner powder image on photoconductive surface 12 of belt 10.

Belt 10 then advances the toner powder image to transfer station D. At transfer station D, a copy sheet is moved into contact with the powder image. Transfer station D includes a corona generating device 70 which sprays ions onto the backside of the copy sheet. This attracts the toner powder image from photoconductive surface 12 to the sheet. After transfer, conveyor 72 advances the sheet to fusing station E.

The copy sheets are advanced from a selected one of the trays 74 or 76 to transfer station D. After transfer of the toner powder image to the first side of the copy sheet, the sheet is advanced by conveyor 72 to fusing station E.

Fusing station E includes a fuser assembly, indicated generally by the reference numeral 78, which permanently affixes the transferred powder image to the copy sheet. Preferably, fuser assembly 78 includes a heated fuser roller 80 and back-up roller 82 with the powder image contacting fuser roller 80. In this manner, the powder image is permanently affixed to the copy sheet.

After fusing, the copy sheets are fed to gate 84 which functions as an inverter selector. Depending upon the position of gate 84, the copy sheets will be deflected into sheet inverter 86, or will bypass inverter 86 and be fed directly to a second decision gate 88. The sheets which bypass inverter 86 turn a 90° corner in the sheet path before reaching gate 88. At gate 88, the sheet is in a face-up orientation with the imaged side, which has been fused, face-up. If inverter path 86 is selected, the opposite is true, i.e., the last printed side is face-down. Decision gate 88 either deflects the sheet directly into an open output tray 90 or deflects the sheets into transport path which carries them onto a third decision gate 92. Gate 92 either passes directly into tray 93 where sheet binding apparatus 95 reciprocates in the direction of arrow 97 so that the glue applicator blade thereof contacts the leading marginal edge of the copy sheet to run a line of glue thereon. Gate 92 may also deflect the sheet onto a duplex inverter roll 94. Roll 94 inverts and stacks the sheets to be duplexed in the duplex tray 96 when gate 92 so directs. Duplex tray 96 provides an intermediate or buffer storage for those sheets which have been printed on one side on which an image will be subsequently printed on the second, opposed, side thereof, i.e., the sheets being duplexed. Due to sheet inverting by roller 94, there buffer sheets are stacked in tray 96 face down. They are stacked in duplex tray 96 face down. They are stacked in duplex tray 96 on top of one another in the order in which they are copied.

In order to complete duplex copying, the simplex sheets in tray 96 are fed, in seriatim, by bottom feeder 98 from tray 96 back to transfer station D for transfer of the toner powder image to the opposed side of the copy sheet. Conveyors 100 and rollers 102 advance the sheet along the path which produces an inversion thereof. However, inasmuch as the bottommost sheet is fed from duplex tray 96, the proper or clean side of the copy sheet is positioned in contact with belt 10 at transfer station D so that the toner powder image is transferred thereto. The duplex tray is then fed through the same path as the simplex sheets to be stacked in tray 90 or, when the adhesive binding option is selected, in tray 93.

Invariably, after the copy sheet is separated from photoconductive surface 12 of belt 10, some residual particles remain adhering thereto. These residual particles are removed from photoconductive surface 12 at cleaning station F. Cleaning station F includes rotatably mounted fibrous brush 104 in contact with photoconductive surface 12 of belt 10. The particles are cleaned from photoconductive surface 12 of belt 10 by the rotation of brush 104 in contact therewith. Subsequent to cleaning, a discharge lamp (not shown) floods photoconductive surface 12 with light to dissipate any residual electrostatic charge remaining thereon prior to the charging thereof for the next successive imaging cycle.

Controller 106 is preferably a programmable microprocessor which controls all the machine functions hereinbefore described. The controller provides a comparison of counts of the copy sheet, the number of documents being recirculated in the document sets, the number of copy sheets selected by the operator, time delays, jam correction, etc. The control of all the exemplary systems heretofore described may be accomplished by conventional control switch inputs from the printing machine console selected by the operator. Conventional sheet path sensors or switches may be utilized for keeping track of the position of the document and the copy sheets. In addition, controller 106 regulates the various positions of the decision gates dependent upon the mode of operation selected. Thus, when the operator selects the adhesive binding mode, adhesive binder 25 will be energized and the decision gates will be oriented so as to advance either the simplex or duplex copy sheet to compiler tray 93, adhesive binder 95 will reciprocate to deposit a line of glue in the leading marginal region of successive sheets advanced to tray 93, in seriatim.

It is believed that the foregoing description is sufficient for purposes of the present application to illustrate the general operation of an electrophogographic printing machine incorporating the features of the present invention therein.

Referring now to the specific subject matter of the present invention, the general operation of adhesive binder 95 will be described hereinafter with reference to FIGS. 2 through 4, inclusive.

Figure 2:
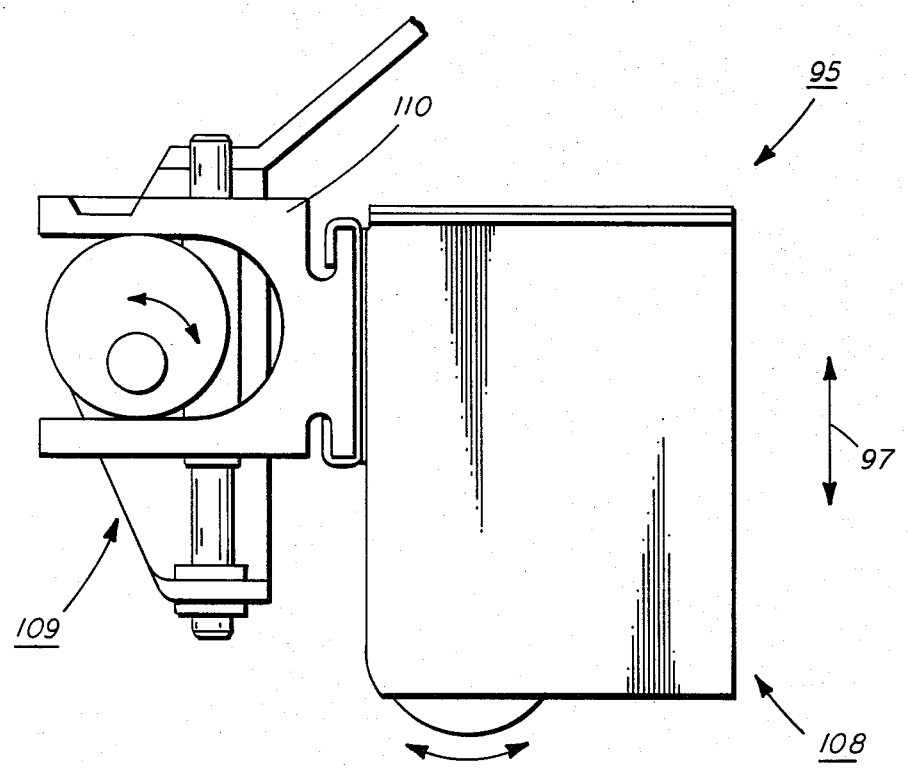
FIG. 2 is a schematic elevational view showing the sheet binding apparatus used in the FIG. 1 printing machine.

As shown in FIG. 2, the adhesive binder, indicated generally by the reference numeral 95, comprises an operator replaceable cartridge, indicated generally by the reference numeral 108. Cartridge 108 is mounted slideably on frame 110. Frame 110 is constrained to move only in the direction of arrow 97. A slider crank mechanism, indicated generally by the reference numeral 109, is coupled to frame 110. An incremental motion wrap spring clutch is used to transmit power from the main drie system of the printing machine to slider crank mechanism 109. When controller 106 indicates that the adhesive binding mode of operation has been selected, and a copy sheet has been transported to the machine drive system. When so coupled, slider crank mechanism 109 reciprocates cartridge 108 in the direction of arrow 97.

After the last copy sheet is advanced into compiler tray 93, the glue applicator blade is retracted into the housing of cartridge 108. Glue is not applied on the last sheet. Cartridge 108 is once again reciprocated so that the bottom portion of the housing thereof engages the stack of sheets and presses them together to form a booklet of sheets. One skilled in the art will appreciate that the first and last copy sheets need not necessarily be sheets but may be covers with pre-printed information thereon, if so desired. Furthermore, one skilled in the art will also appreciate that other information such as photographs, may be interleafed between the copy sheets to provide additional information other than the copy sheets for the booklet, if so desired.

Figure 3:
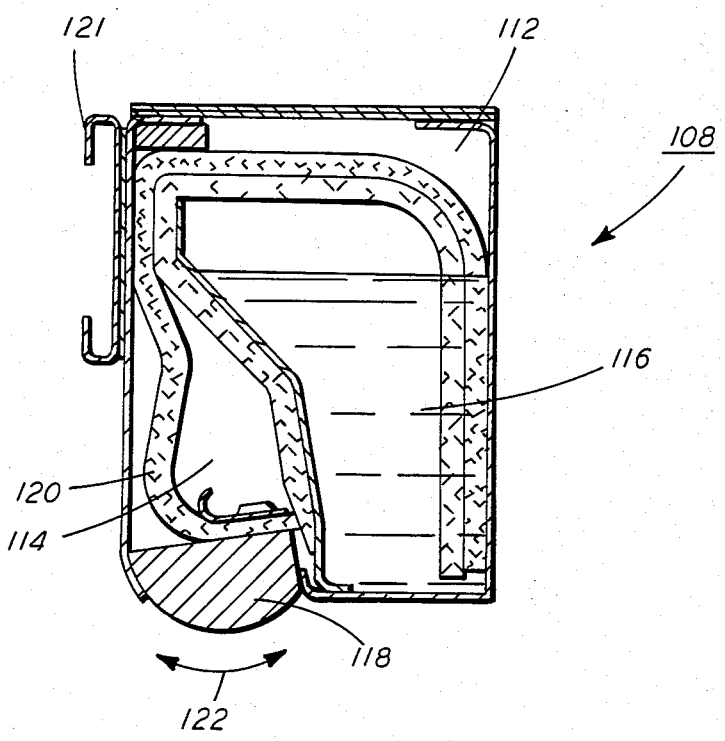
FIG. 3 is an elevational view depicting, in greater detail, one embodiment of the FIG. 2 sheet binding apparatus.
Figure 3A:
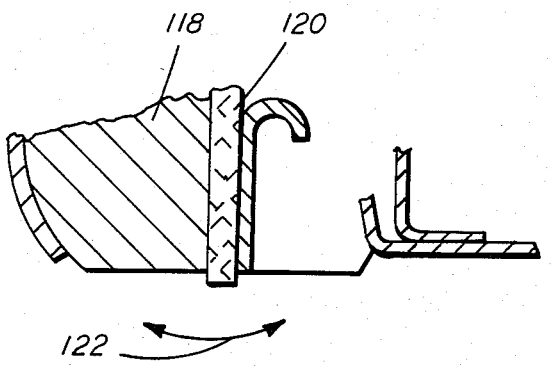

Turning now to FIG. 3, there is shown the details of cartridge 108. As illustrated thereat, cartridge 108 includes a housing 111 defining chambers 112 and 114. Chamber 112 is substantially closed and stores a supply of glue 116 therein. Chamber 114 has an open end with a rotary valve 118 disposed therein. A glue applicator blade 120 made from a flexible wick, has a portion thereof extending into glue 116 in chamber 112. The other portion of applicator blade 120 extends into chamber 114. When rotary valve 118 is positioned as shown in FIG. 3, applicator blade 120 is retracted into chamber 114. However, when rotary valve 118 is energized to rotate, in the clockwise direction of arrow 122, applicator blade 120 extends outwardly from housing 111. Housing 111 has a bracket 121 enabling it to be mounted slidably on frame 110. Thus, in the inoperative mode, valve 118 is rotated in the counter clockwise direction of arrow 122 to retract blade 120 into chamber 114 of housing 111. In the operative mode, valve 118 rotates in the clockwise direction of arrow 122 to enable applicator blade 120 to extend outwardly from housing 111. This latter orientation is shown more clearly in FIG. 3(*a*).

Referring now to FIG. 3(*a*) there is shown valve 118 rotated in the clockwise direction of arrow 122 to enable applicator blade 120 to extend outwardly from housing 111 (FIG. 3). Microprocessor 106 controls the actuation of rotary valve 118, which may be driven by a suitable linkage coupled to a drive motor or, in lieu thereof, a solenoid may be employed. Applicator blade 120 extends the width of a copy sheet. Thus, the depth of the wick 120 is equal to the width of the edge of the copy sheet perpendicular to the path of travel thereof. Preferably, blade 120 is made from a suitable wicking material, such as a compressed reticulated foam that is used for transporting liquids from a reservoir to an application surface. The capillary wicking properties are a result of reduced average pore size which is achieved by compression. A wick of this type is made by the Scott Paper Company under the trademark Scott Felt and provides controlled capillary action. The wick is preferably 2 millimeters wide with the depth thereof being equal to the length of the sheet having adhesive deposited thereon. Glue 116, (FIG. 3), is preferably a water based polyethylene vinyl acetate resin emulsion made by the National Starch and Chemical Corporation and designated by number 33-3003. This type of glue or adhesive is typically used in the paper binding industry and has no organic solvents. The ph of this product is approximately 4.5, however, it may be buffered to a neutral ph, if necessary.

In operation, microprocessor 106 actuates rotary valve 118 to rotate in the clockwise direction of arrow 122 extending applicator blade 120 from housing 111. When the first copy sheet is registered in the compiler tray, slider crank mechanism 112 moves housing 111 downwardly so that the glue applicator blade presses against the copy sheet depositing a line of glue thereon. Thereafter, slider crank mechanism 112 moves housing 111 upwardly to space the glue applicator blade from the first copy sheet. At this time, the second copy sheet advances into the compiler tray over the first copy sheet. Housing 111, once again, moves in a downwardly direction so that the glue applicator blade presses against the second copy sheet. The weight of the housing causes the glue applicator blade to be compressed so that a line of glue is deposited on the second sheet simultaneously with the sheets being pressed together. The foregoing process continues, until the last sheet enters the compiler tray. At this time, valve 118 rotates in the counter clockwise direction of arrow 122 to retract blade 120 into housing 111. Housing 111 moves downwardly to press the stack of sheets together, a final time, without applying glue to the last sheet. In the embodiment heretofore described, glue is placed in the housing and no provision is contained therein for furnishing additional glue after the supply in the housing is depleted. In this configuration, the entire cartridge is discarded after the glue is depleted therefrom. In operation, this would probably occur after several thousand copies have had a line of glue formed in the marginal region thereof. An alternate embodiment is shown in FIG. 4 wherein a glue reservoir is provided for the cartridge.

Figure 4:
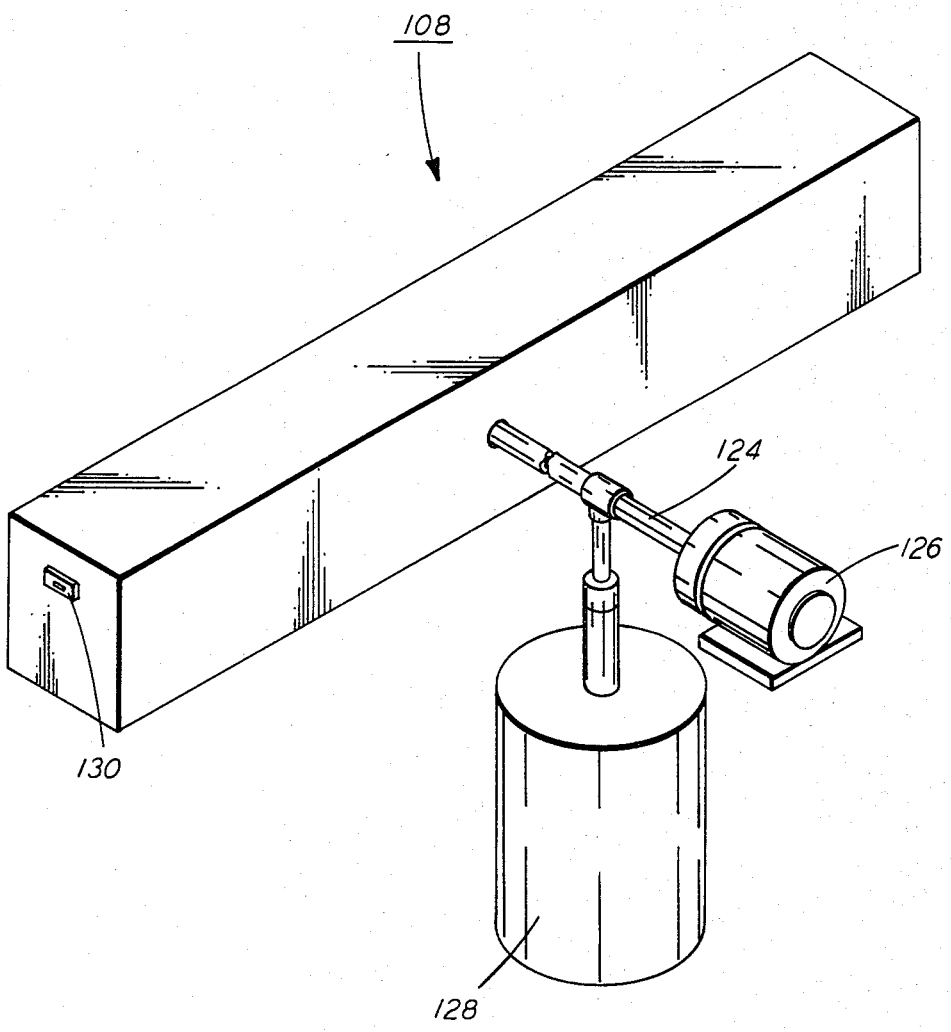
FIG. 4 is an elevation view depicting another embodiment of the FIG. 2 sheet binding apparatus.

As shown in FIG. 4, a flexible conduit 124, couples cartridge 108 to pump 126 and container 128. A sensor 130 is positioned interiorly of housing 111 of cartridge 108. Sensor 130 is located at the desired glue level and detects when the level of the glue drops beneath this position. By way of example, sensor 130 may be a pie 30 electric sensor which produces an electrical output signal when the glue level is beneath the desired height. This output signal actuates pump 126 which causes the glue in container 128 to flow through conduit 120 to housing 111 of cartridge 108. In this way, the glue level within housing 111 of cartridge 108 is maintained substantially constant and the life of the cartridge significantly increased.

In recapitulation, in operation, the machine operator selects the adhesive binding mode. The adhesive binder is energized, and after the first sheet is aligned and registered in the compiler tray, the glue applicator blade having glue thereon extends outwardly from the housing thereof. The cartridge now moves in a downwardly direction to deposit a line of glue on the leading marginal edge of the sheet and presses the sheets together. After the line of glue has been deposited on the sheet, the cartridge moves in an upwardly direction spacing applicator blade form the sheet. The next copy sheet is then transported into the compiler tray over the prior copy sheet aligned and registered therein. At that time, the cartridge moves once again in a downwardly direction to deposit a line of glue on this copy sheet in the marginal region thereof, and to press the sheets together. This mode of operation continues until the last copy sheet is advanced into the compiler tray. At this time, the glue applicator blade is retracted into the housing and the cartridge is now in the inoperative mode. However, in this mode the housing is reciprocated once again in a downwardly direction to press the stack of sheets together to form a booklet thereof. At all times, other than when in the operative mode, the applicator blade is stored internally of the housing in the anti-congeal position. The rotary valve is closed and the glue on the blade does not solidfy.

It is, therefore, evident that there has been provided in accordance with the present invention an apparatus for adhesively binding together sheets to form a booklet thereof. This apparatus fully satisfied the aims and advantages hereinbefore set forth. While this invention has been described in conjunction with various embodiments thereof, it is evident that many alternatives, modifications and variations would be apparent to those skilled in the art. Accordingly, it is intended to embrace all such alternatives, modifications and variations as fall within the spirit and broad scope of the appended claims.

I claim:

1. An apparatus for adhesively binding together a plurality of sheets to form a bound booklet thereof, including:

means for receiving successive sheets;

an operator replaceable cartridge comprising a housing storing a supply of adhesive threein, a glue applicator blade, in communication with the housing, and being of a length at least equal to the length of the marginal region of the sheet adapted to have glue deposited thereon, and means for extending a portion of the blade from the housing in the operative mode when applying glue to the sheets and retracting the portion of the blade extending from the housing into the housing in the inoperative mode; and means for reciprocating the cartridge so that the portion of the blade extending outwardly from the housing thereof contacts the marginal region of successive sheets in said receiving means to apply a strip of glue thereon.

2. An apparatus according to claim 1, wherein said reciprocating means reciprocates said cartridge in the inoperative mode with the blade being retracted into the housing so that a portion of the housing engages sheets in said receiving means to press the sheets together to form a booklet thereof.

3. An apparatus according to claim 2, wherein the housing of said cartridge defines a first chamber for storing the glue therein and a second chamber, in communication with the first chamber, for storing a portion of the applicator blade therein.

4. An apparatus according to claim 3, wherein the applicator blade is a flexible wick having a portion thereof in the glue of the first chamber of the housing and another portion thereof in the second chamber thereof.

5. An apparatus according to claim 4, wherein the second chamber of the housing of said cartridge has an open end through which a portion of the wick extends in the operative mode.

6. An apparatus according to claim 5, wherein said cartridge further includes means, positioned in the open end of the second chamber of the housing, for retracting the portion of the wick extending from the housing into the second chamber of the housing in the inoperative mode and extending a portion of the wick therefrom in the operative mode.

7. An apparatus according to claim 6, further including:

means, positioned externally of said cartridge and in communication with the first chamber of the housing thereof, for storing a supply of glue therein; and means, in communication with said storing means and the first chamber of housing of said cartridge, for controlling the amount of glue in the first chamber of the housing of said cartridge.

8. A printing system, including:

means for reproducing indicia on successive sheets;

means for advancing at least the sheets having indicia reproduced thereon, in seriatum, along a sheet path; and means for adhesively binding together the sheets along the marginal region thereof extending in a direction substantially perpendicular to the sheet path to form a bound booklet thereof, said binding means comprising a housing storing a supply of adhesive therein, a glue applicator blade, in communication with the glue in the housing, and being of a length at least equal to the length of the marginal region of the sheet adapted to have glue deposited thereon, means for extending a portion of the blade from the housing in the operative mode when applying glue to the sheets and retracting the portion of the blade extending from the housing into the housing in the inoperative mode, and means for reciprocating said binding means so that the portion of the blade extending outwardly from the housing thereof contacts the marginal regional of successive sheets to apply a strip of glue thereon.

9. A printing system according to claim 8, wherein the reciprocating means of said binding means reciprocates the housing in the inoperative mode with the blade being retracted into the housing so that a portion of the housing engages the sheets to the press sheets together to form a booklet thereof.

10. A printing system according to claim 9, wherein the housing of said binding means defines a first chamber for storing the glue therein and a second chamber, in communication with the first chamber, for storing a portion of the applicator blade therein.

11. A printing system according to claim 10, wherein the applicator blade is a flexible wick having a protion thereof in the glue of the first chamber of the housing and another portion thereof in the second chamber thereof.

12. A printing system according to claim 11, wherein the second chamber of the housing of said cartridge has an open end through which a portion of the wick extends in the operative mode.

13. A printing system according to claim 12, wherein said binding means further includes means, positioned in the open end of the second chamber of the housing, for retracting the portion of the wick extending from the housing into the second chamber of the housing in the inoperative mode and extending a portion of the wick therefrom in the operative mode.

14. A printing system according to claim 13, further including:

means, positioned externally of said binding means and in communication with the first chamber of the housing thereof, for storing a supply of glue therein; and means, in communication with said storing means and the first chamber of the housing of said binding means, for controlling the amount of glue in the first chamber of the housing of said binding means.

* * * * *